US007775459B2

(12) United States Patent
Martens, III et al.

(10) Patent No.: US 7,775,459 B2
(45) Date of Patent: Aug. 17, 2010

(54) LIQUID ATOMIZING DEVICE WITH REDUCED SETTLING OF ATOMIZED LIQUID DROPLETS

(75) Inventors: Edward J. Martens, III, Racine, WI (US); Heather R. Schramm, Whitewater, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 993 days.

(21) Appl. No.: 10/868,777

(22) Filed: Jun. 17, 2004

(65) Prior Publication Data

US 2005/0279854 A1 Dec. 22, 2005

(51) Int. Cl.
*B05B 9/06* (2006.01)
*B05B 1/08* (2006.01)
*B05B 1/00* (2006.01)

(52) U.S. Cl. ..... 239/102.2; 239/101; 239/124; 239/596; 128/200.16; 128/200.14

(58) Field of Classification Search ..... 239/4, 239/101, 102.2, 124, 596, 302, 548; 128/200.16, 128/200.14
See application file for complete search history.

(56) References Cited

U.S. PATENT DOCUMENTS 3,901,443 A 8/1975 Mitsui et al.
3,997,115 A 12/1976 Licudine
4,605,167 A 8/1986 Maehara
4,746,466 A 5/1988 Takahashi
4,790,479 A * 12/1988 Matsumoto et al. ..... 239/102.2
4,793,339 A * 12/1988 Matsumoto et al. .... 128/200.16
4,961,885 A 10/1990 Avrahami et al.
5,221,025 A 6/1993 Privas
5,620,633 A 4/1997 Junkel et al.
5,624,608 A 4/1997 Ching et al.
5,803,362 A 9/1998 Fraccaroli
5,837,167 A 11/1998 Lederer
5,843,344 A 12/1998 Junkel et al.
6,062,212 A 5/2000 Davison et al. ..... 128/200.16
6,161,777 A 12/2000 Carter et al.
6,216,961 B1 4/2001 Utter et al.
6,247,525 B1 6/2001 Smith et al.
6,293,474 B1 * 9/2001 Helf et al. ..... 239/102.2
6,296,196 B1 10/2001 Denen et al. ..... 239/4
6,340,283 B1 1/2002 Hedger et al.

(Continued)

FOREIGN PATENT DOCUMENTS

EP 1184083 A1 3/2002

(Continued)

OTHER PUBLICATIONS

Office Action in U.S. Appl. No. 10/549,435 dated Dec. 8, 2008.

*Primary Examiner*—Len Tran
*Assistant Examiner*—James S Hogan

(57) ABSTRACT

A liquid atomizing device for dispensing liquid droplets includes a container for holding a liquid, the container having a porous wick positioned to communicate the liquid from the container, and an orifice plate with apertures, the orifice plate being vibrated by a piezoelectric element to cause liquid communicated from the container to be atomized and dispensed as liquid droplets through the apertures. The device employs a unique placement and design of heaters or fans to promote evaporation and dispersion of the atomized liquid while the liquid is airborne.

13 Claims, 11 Drawing Sheets

U.S. PATENT DOCUMENTS

| | | | | |
|---|---|---|---|---|
| 6,341,732 | B1 * | 1/2002 | Martin et al. | 239/4 |
| 6,371,451 | B1 | 4/2002 | Choi | 261/26 |
| 6,378,988 | B1 | 4/2002 | Taylor et al. | 347/49 |
| 6,390,453 | B1 * | 5/2002 | Frederickson et al. | 261/26 |
| 6,390,543 | B1 * | 5/2002 | Tolinski | 296/217 |
| 6,405,934 | B1 | 6/2002 | Hess et al. | 239/4 |
| 6,554,203 | B2 | 4/2003 | Hess et al. | 239/69 |
| 6,623,785 | B2 | 9/2003 | Childers | |
| 6,726,186 | B2 * | 4/2004 | Gaaloul et al. | 261/81 |
| 6,793,149 | B2 * | 9/2004 | Schramm et al. | 239/102.1 |
| 6,843,430 | B2 * | 1/2005 | Boticki et al. | 239/102.1 |

FOREIGN PATENT DOCUMENTS

| | | |
|---|---|---|
| WO | WO 03/068413 | 8/2003 |

* cited by examiner

LIQUID ATOMIZING DEVICE WITH REDUCED SETTLING OF ATOMIZED LIQUID DROPLETS

BACKGROUND OF THE INVENTION

1. Field of the Invention

Our invention relates to liquid atomizing devices. In particular, our invention relates to an improved liquid atomizing device, for atomizing liquids to disperse droplets thereof into the ambient air, which is able to reduce the amount of atomized liquid droplets that fall onto proximate surfaces by increasing the evaporation rate of the atomized liquid.

2. Description of the Related Art and Problem to Be Solved

Devices that release vapors into the ambient air are well-known in the art. The purpose of these devices may be to deodorize, disinfect, or impart a desired fragrance to the ambient air, to deliver a medical or cosmetic spray, to humidify, or to distribute toxins into the air to kill or to repel unwanted pests, such as insects.

Several methods have been employed to dispense vapors into the air. For example, some methods utilize the evaporative properties of liquids, or of other vaporizable materials, to cause vapors with desired properties to be distributed into the ambient air. One such evaporative method utilizes a wick to deliver a vaporizable liquid from a reservoir to a surface exposed to the ambient air, from which surface the liquid is vaporized and dispersed into the air. Other methods, however, involve atomizing the liquid—that is, reducing the liquid into tiny particles that are dispersed into the air as a fine spray.

U.S. Pat. No. 6,293,474 B1 to Helf et al., assigned to the assignee of this application, describes an example of a device for dispensing liquids as an atomized spray. This patent is incorporated in its entirety in this description by reference. Helf et al. discloses the production of a fine spray of liquid droplets using a continuous action dispenser having an orifice plate in communication with a piezoelectric element which expands and contracts when alternating voltages are applied thereto. A wick delivers liquid to be atomized from a container to the orifice plate, and the vibration of the orifice plate, communicated by the piezoelectric element, causes droplets to be ejected into the air. This system achieves preferred dispensing of the liquid.

However, with atomization devices, a potential problem is that the atomized liquid droplets can settle back onto the device, and/or onto surfaces around the device, before they completely evaporate. This problem can be of particular concern, for example, with respect to insect control or air-freshening liquid formulations because such formulations often contain strong solvents that are harmful to surfaces, especially surfaces with fine lacquered wood finishes. Consumers often place liquid atomizing devices on such surfaces (e.g., on wooden furniture such as a table or a dresser), and when atomized liquid droplets fail to evaporate, and instead settle down onto the adjacent surfaces, the droplets can cause the finish on the surfaces to be damaged, among other unwanted effects.

To address this concern, changing the character of the dispensed liquid has been suggested. For example, the specific formulation of the dispensed liquid might be altered so that the liquid will not act as a furniture-stripping agent if it comes in contact with a finished wooden surface. This approach, however, can limit the selection of liquid components that can be used, especially the selection of usable fragrance components.

But even when the particular composition of the liquid formulation in a device is not necessarily damaging to a given surface, the accumulation of droplets on a surface can still be bothersome. For example, a plastic surface or a glass surface that does not react with the liquid formulation must still be cleaned by the user of the device after droplets have collected on that surface. As another example, a particular liquid formulation might not actually harm an area of carpet fibers or a fabric surface, but it could still be a nuisance due to being absorbable into the carpet or fabric.

Also of concern is that droplets can settle back onto the liquid atomizing device itself, presenting a nuisance and/or adversely affecting further atomization and efficient dispersion, such as by clogging the orifices through which the atomized liquid droplets are ejected into the air.

Accordingly, in a liquid atomizing device, there is a need to minimize the amount of atomized liquid droplets that fail to evaporate fully before settling down on the device and/or surrounding surfaces. It is part of our invention to include such features in an improved liquid atomizing device.

While it has previously been suggested that liquid atomizing devices can include a heater, a fan, or both a heater and a fan, we believe that such earlier devices do not use heaters and/or fans to solve the problems of the prior art as our invention does.

For instance, U.S. Pat. No. 6,378,988 B1 to Taylor et al. relates to a replaceable cartridge for micro jet dispensing assemblies containing a micro jet piezoelectric ejector. In this device, the piezoelectric ejector ejects micro-droplets of volatile fluids onto a heatable surface, wetting the heatable surface. This heatable surface aids in volatilization of the fluid.

U.S. Pat. No. 6,062,212 to Davison et al. teaches a dispensing apparatus that disperses an atomized spray through an outlet. Specifically, a droplet of liquid is metered onto a membrane which is vibrated by a piezoelectric transducer such that atomized droplets are dispensed through holes formed in the membrane. In one embodiment of that invention, an electric fan is provided at one end of a duct into which droplets are dispensed as an aerosol mist. The fan creates a flow of air that helps to deliver the mist atraumatically to an eye engaged with an eye cup at the opposite end of the duct.

U.S. Pat. No. 6,371,451 B1 to Choi teaches a scent diffusion method. In a scent-spraying unit, scents in scent cartridges are dispensed through piezoelectric-type or thermal jet spray-type spraying nozzles into an evaporation dish provided with a heater. An exhaust fan is driven to discharge the evaporated scent from the unit. According to this patent, it is preferable that a residual liquid scent is inhaled upon termination of each spraying operation, in order to prevent the spraying nozzles from being clogged.

U.S. Pat. No. 6,390,453 B1 to Frederickson et al. discloses a method and an apparatus that employ a pulse-controlled micro-droplet fluid delivery system for precisely dispensing fragrances and other odor-producing vapors. In one embodiment, a print head dispenses droplets directly onto the heated surface of a heater, wetting the heater. The apparatus includes a blower, adjacent to the heater, which creates air flow that carries vapor through an air-flow channel leading to the outside of the apparatus.

In another embodiment, a target medium intercepts droplets as they are dispensed approximately sideways, toward the outlet of the apparatus. A blower in the apparatus is mounted in a housing containing a heating element. This assembly warms and heats the air being moved, which, together with the vapor produced by evaporation of the dispensed droplets, proceeds through the target medium to an air-flow outlet.

U.S. Pat. No. 6,554,203 B2 to Hess et al. relates to a smart miniature fragrance-dispensing device for multiple ambient scenting applications and environments. Within the device, a liquid spray dispenser dispenses droplets of a principal medium into a flow channel, which is a controllable induced mixed media flow channel for mixing the principal medium with an ambient medium contained within the flow channel. The flow channel, which has heaters in the form of flow inducing elements, expels the mixed media through an outlet into the environment. The device has a piezoelectric driving circuit for exciting a piezoelectric element, to dispense droplets from the liquid spray dispenser.

U.S. Pat. No. 6,405,934 B1 to Hess et al., which relates to an optimized liquid droplet spray device for an inhaler suitable for respiratory therapies, describes a spray device with a chamber for containing a liquid formed of a top substrate and a bottom substrate. The top substrate has outlet means consisting of cavities, outlet nozzles, and outlet channels. A piezoelectric element disposed beneath the bottom substrate constitutes vibrating means and can also act as a heater. A separate flexible heating surface, fitted on the two substrates, can also be included in the spray device.

While these documents describe various combinations of piezoelectric-type atomizing devices, heaters, and fans for dispensing volatile substances, none of these patents adequately teaches suitable improvements for minimizing the amount of atomized liquid droplets that settle on the device and/or its surrounding surfaces by increasing the evaporation rate of dispensed droplets, in the manners set forth below.

SUMMARY OF THE INVENTION

Our invention is directed to providing improved atomizing devices that employ unique means for enhancing the evaporation rate of the atomized liquid while the liquid is airborne. Preferably, such improvements include the unique placement and design of heaters and/or fans used in an atomization device.

In one preferred aspect, this invention provides a liquid atomizing device for dispensing liquid droplets, the liquid droplets being provided from a container holding a liquid, the container comprising a porous wick positioned to transfer/communicate the liquid from the container. The device preferably includes an orifice plate with apertures, the orifice plate being vibrated by a piezoelectric element to cause liquid communicated from the container to be atomized and dispensed as liquid droplets through the apertures, and a fan preferably disposed below a main body defined by the container and the orifice plate. In the device, the fan increases at least one of the evaporation rate and dispersion of the liquid droplets dispensed through the apertures of the orifice plate.

The invention provides, in a second preferred aspect, another liquid atomizing device for dispensing liquid droplets, the liquid droplets being provided from a container holding a liquid, the container comprising a porous wick positioned to communicate the liquid from the container. The device preferably includes an orifice plate with apertures, the orifice plate being vibrated by a piezoelectric element to cause liquid communicated from the container to be atomized and dispensed as liquid droplets through the apertures, a resistor trace coupled to the orifice plate, and a heating element coupled to the resistor trace. The heating element heats the liquid communicated from the container. That heating preferably increases the evaporation rate of the liquid droplets.

In a third preferred aspect, the invention provides a liquid atomizing device for dispensing liquid droplets, the liquid droplets being provided from a container holding a liquid, the container comprising a wicking element having a porous wick positioned to communicate the liquid from the container. This device preferably includes an orifice plate with apertures, the orifice plate being vibrated by a piezoelectric element to cause liquid communicated from the container to be atomized and dispensed as liquid droplets through the apertures, a thermally conducting tube surrounding a top portion of the wicking element when the container is mounted to the device, and a heating element coupled to the thermally conducting tube. In the device, the heating element preferably heats the top portion of the wicking element. Heat from the heating element raises the temperature of the liquid in the wick which is being delivered to the orifice plate, which preferably increases the evaporation rate of the liquid dispensed as liquid droplets.

In a fourth preferred aspect, the invention provides a liquid atomizing device for dispensing liquid droplets, the liquid droplets being provided from a container holding a liquid, the container comprising a porous wick positioned to communicate the liquid from the container. The device preferably includes an orifice plate with apertures, the orifice plate being vibrated by a piezoelectric element to cause liquid communicated from the container to be atomized and dispensed as liquid droplets through the apertures, and a heating chamber disposed on a side of the orifice plate opposite the side communicating with the wick. The heating chamber has an inlet and an outlet, and is positioned so that the liquid droplets dispensed into the ambient air through the apertures of the orifice plate are projected up through the heating chamber, entering the inlet and exiting the outlet. This heating chamber heats the liquid droplets dispensed through the apertures of the orifice plate, thereby increasing the evaporation rate of the liquid droplets.

In a fifth preferred aspect, the invention provides a liquid atomizing device for dispensing liquid droplets, the liquid droplets being provided from a container holding a liquid, the container comprising a porous wick positioned to communicate the liquid from the container. The device preferably includes an orifice plate with apertures, the orifice plate being vibrated by a piezoelectric element to cause liquid communicated from the container to be atomized and dispensed as liquid droplets through the apertures, and a heating element provided on a circuit board in the device. The heating element creates heat that increases the evaporation rate of the liquid droplets. Convection currents caused by the heating element may also help liquid droplet dispersion by moving particles to a greater height, increasing the amount of time that the liquid droplets have to evaporate before settling occurs.

DETAILED DESCRIPTION OF THE INVENTION

Description of the Atomizing Device

Figure 1B:
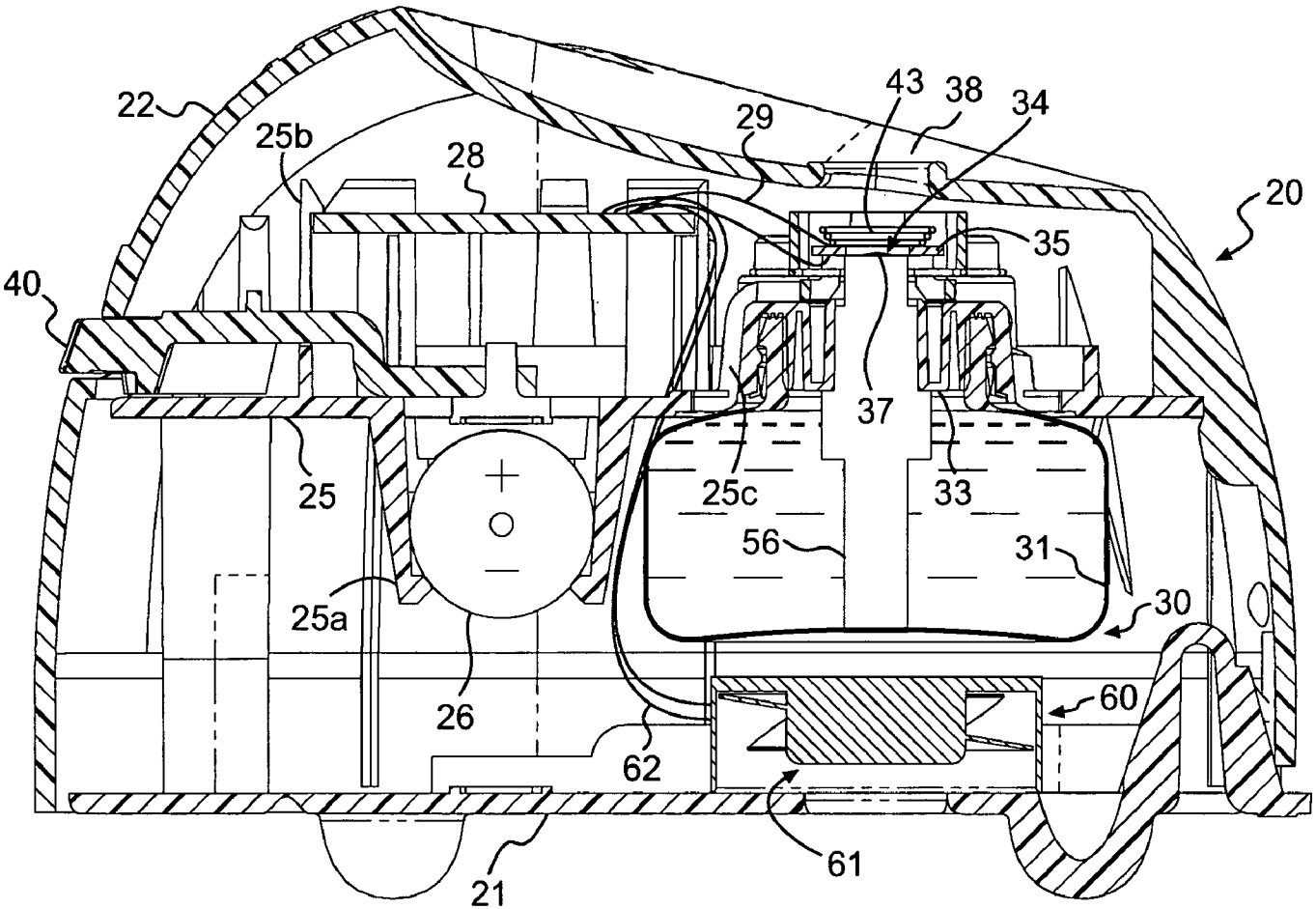
FIG. 1B is cross-sectional view along the line 1B-1B in FIG. 1A.
Figure 1A:
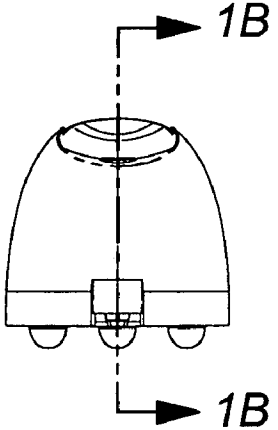
FIG. 1A is an elevational view of an atomizing device for use in an embodiment of the invention.

As shown in FIG. 1B, a piezoelectrically-actuated atomization device 20 generally comprises an atomizing assembly 34, which includes an orifice plate 37 and a replaceable reservoir assembly 30. The reservoir assembly 30 includes a reservoir 31 containing fluid and a wick 56. When one reservoir assembly 30 is removed by a user and replaced with another reservoir assembly, the wick 56 automatically delivers fluid to the orifice plate 37.

The atomization device 20 comprises a housing 22 formed as a hollow plastic shell with a removable base 21. A horizontal platform 25 extends across the interior of the housing 22. A battery 26 is supported by means of support prongs 25*a* that extend down from the underside of the platform 25 inside the housing 22. In addition, a printed circuit board 28 is supported on support elements 25*b* that extend upwardly from the platform 25. The liquid reservoir assembly 30 is replaceably mounted to the underside of a dome-like formation 25*c* on the platform 25.

The liquid reservoir assembly 30 comprises the liquid container 31 for holding a liquid to be atomized, a plug 33, which closes the top of the container, and the wick 56, which extends from within the liquid container 31 through the plug 33, to a location above the liquid container 31. The plug 33 is constructed to allow removal and replacement of the complete liquid reservoir assembly 30 from the underside of the dome-like formation 25*c* on the platform 25. When the replaceable liquid reservoir assembly 30 is mounted on the platform 25, the wick 56 extends up through a center opening in the dome-like formation 25*c*. The wick 56 operates by capillary action to deliver liquid from within the liquid container 31 to a location just above the dome-like formation 25*c* on the platform 25.

The atomizing assembly 34 comprises an annularly-shaped piezoelectric actuator element 35 and the circular orifice plate 37, which extends across and is soldered or otherwise affixed to the actuator element 35. A construction of a vibrator-type atomizing assembly is well known and is described, for example, in U.S. Pat. No. 6,296,196 B1 to Denen et al. Accordingly, the atomizing assembly 34 will not be described in detail except to say that when alternating voltages are applied to opposite upper and lower sides of the actuator element 35, these voltages produce electrical fields across the actuator element and cause it to expand and contract in radial directions. This expansion and contraction is communicated to the orifice plate 37, causing it to flex, so that a center region thereof vibrates up and down. The center region of the orifice plate 37 is domed slightly in an upward direction, to provide stiffness and to enhance atomization. The center region is also formed with a plurality of minute orifices which extend through the orifice plate 37 from the lower or under surface of the orifice plate 37 to its upper surface. The vibration of the orifice plate 37 causes liquid droplets to be ejected through the minute orifices, out through opening 38, into the air.

During operation, the battery 26 supplies electrical power to circuits on the printed circuit board 28, and these circuits convert the electrical power to high frequency alternating voltages. (Of course, power may also be provided by a power cord plugged into an electrical outlet, or by other conventional means, in other embodiments.) A suitable circuit for producing these voltages is shown and described by Denen et al. The alternating voltages are delivered to the opposite upper and lower sides of the actuator element 35 from the printed circuit board 28 via wires 29.

The atomizing device may be operated during successive on and off times, the relative durations of which can be adjusted by a control switch 40 that is coupled to the printed circuit board 28 by conventional means. In other embodiments, the on and off times may be controlled by a preset program, or controlled by a user interface working through a processor. Typically, the atomizing device is set to release atomized liquid approximately every 9 to 36 seconds, each time for about 11 milliseconds. Therefore, a puff of atomized liquid (for example, a fragrance) is emitted every 9 to 36 seconds, with the frequency of the puffs controlling the intensity of the fragrance.

The atomizing assembly 34 is supported above the liquid reservoir assembly 30 such that the upper end of the wick 56 touches the underside of the orifice plate 37. Thus, the wick 56 delivers liquid from within the liquid reservoir 31 by capillary action to the underside of the orifice plate 37, which, upon vibration, causes the liquid to pass through its orifices and be ejected from its opposite side (that is, its upper surface) in the form of very small droplets.

The horizontal platform 25 serves as a common structural support for both the liquid reservoir assembly 30 and the atomizing assembly 34. Thus, the horizontal platform 25 maintains the liquid reservoir assembly 30, and particularly, the upper end of the wick 56, in alignment with the orifice plate 37 of the atomizing assembly 34. Moreover, because the atomizing assembly 34 and the orifice plate 37 are resiliently mounted, the upper end of the wick 56 will press against the under surface of the orifice plate 37 and/or the actuator element 35 regardless of dimensional variations in the liquid reservoir assembly 30 that may occur due to manufacturing tolerances. This is because if a wick 56 of the replacement liquid reservoir assembly 30 is higher or lower than the wick 56 of the original liquid reservoir assembly 30, the action of a spring 43 will allow the orifice plate 37 to move up and down according to the location of the wick 56 in the replacement reservoir assembly 30 so that the wick 56 will suitably press against the underside of the orifice plate 37 and/or the actuator element 35. The wick 56 is preferably formed of a substantially solid, dimensionally stable material so that it will not become overly deformed when pressed against the underside of the resiliently supported orifice plate 37.

Other atomization devices may be substituted, as desired, in consideration of design choices, manufacturing costs, and the like. The above-described atomization device, however, is preferred for use in systems according to our invention.

Fans for the Atomizing Device

In FIG. 1B, fan assembly 60 is disposed beneath the reservoir assembly 30. In this embodiment, the fan assembly 60 comprises a DC brushless fan 61.

As would be known in the art, current can be delivered by wires (not shown) from the battery 26 directly to the DC brushless fan 61, or by wires 62 connecting the printed circuit board 28 to the DC brushless fan 61.

The DC brushless fan 61 is activated to increase the airflow within the atomization device 20. The increased airflow enhances the evaporation and dispersion of atomized liquid droplets dispensed through the orifice plate 37 such that the amount of atomized liquid droplets that re-settle before evaporating is reduced.

Figure 2A:
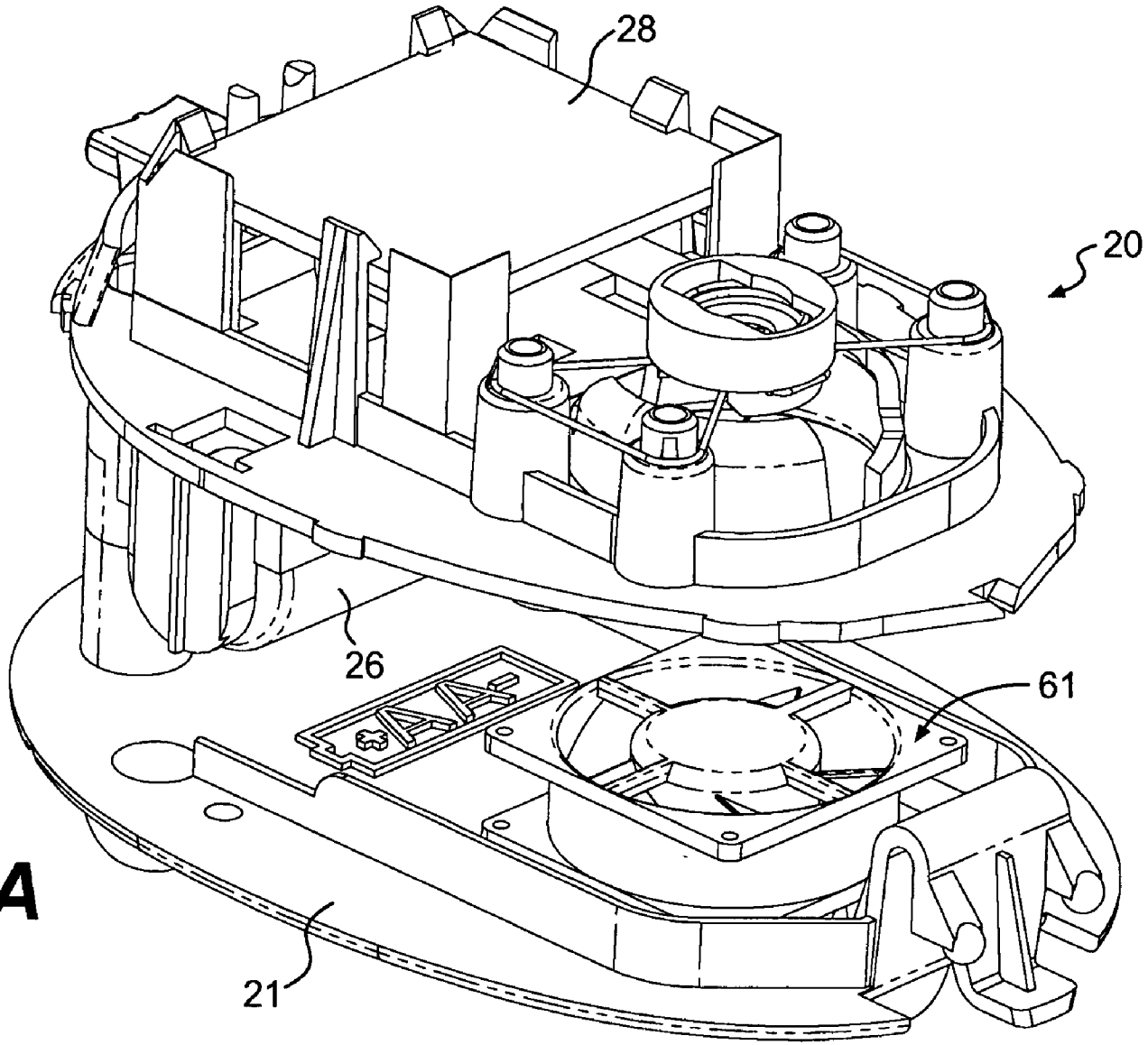
FIGS. 2A, 2B, 2C, and 2D show other elevational views of the atomizing device depicted in FIG. 1A.
Figure 2B:
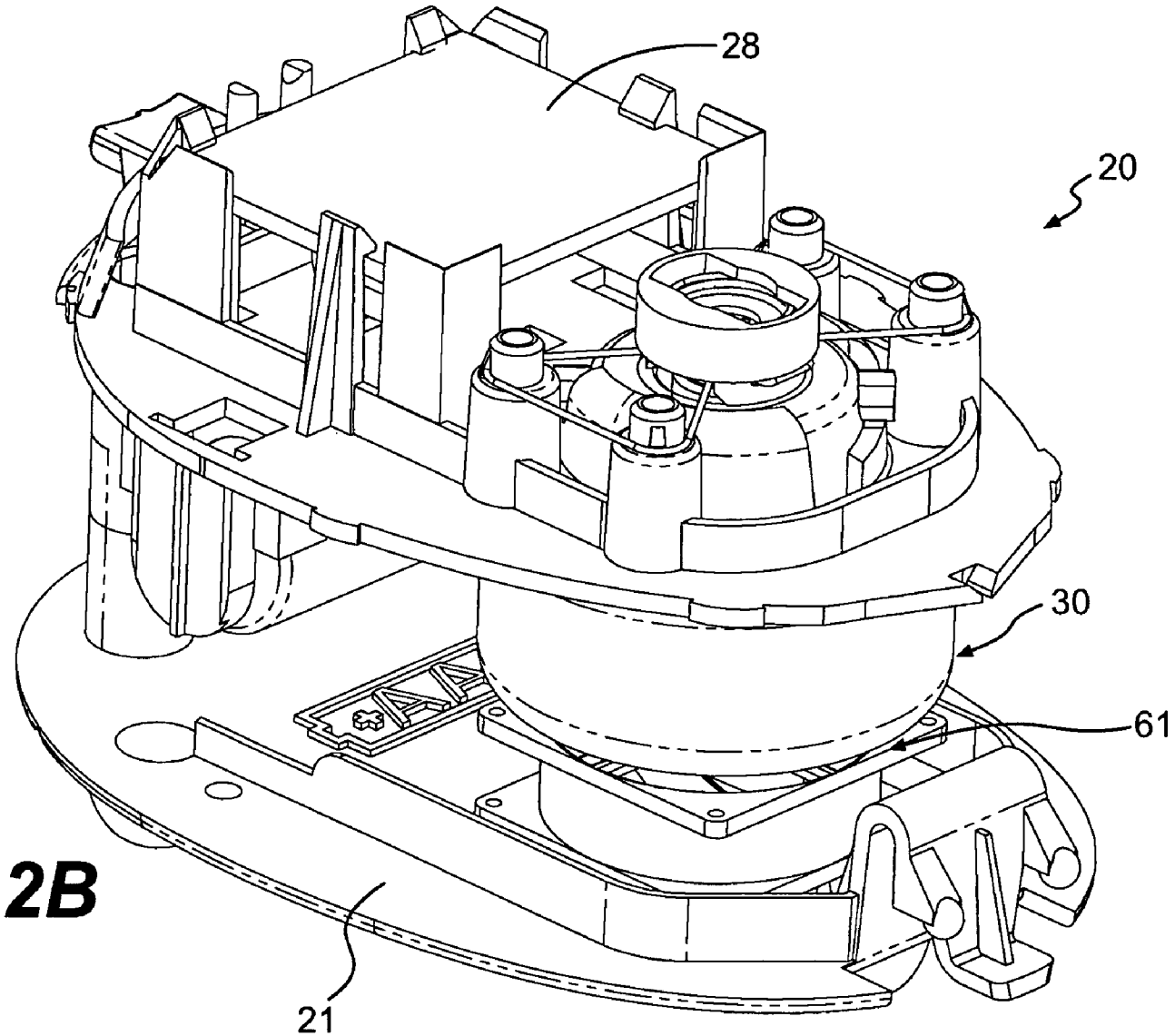

In FIG. 2A, the device of FIG. 1B is drawn without the housing 22 or the liquid reservoir assembly 30 so as to show another view of the DC brushless fan 61. FIG. 2B shows the liquid reservoir assembly 30 mounted in place above the DC brushless fan 61.

Figure 2C:
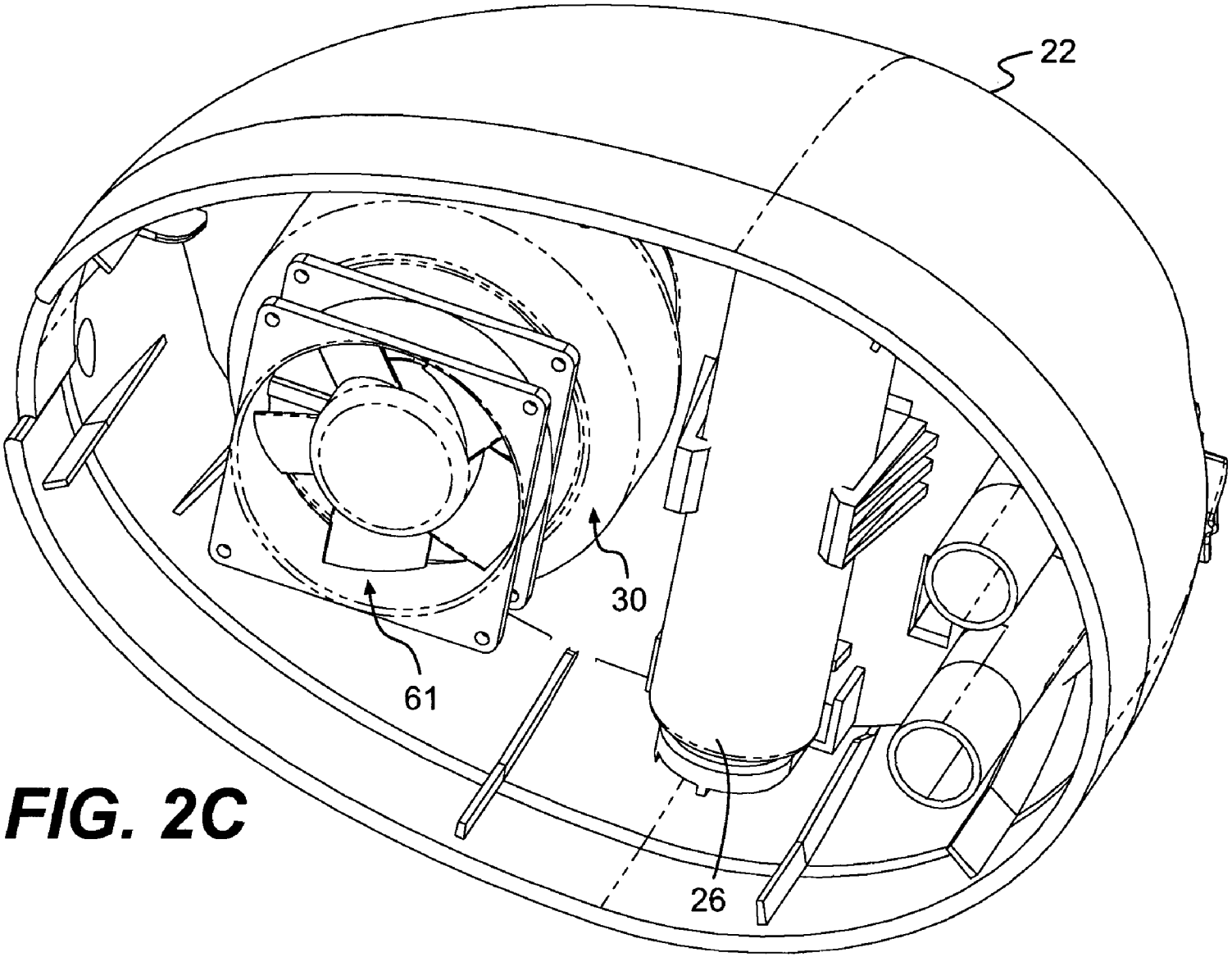
Figure 2D:
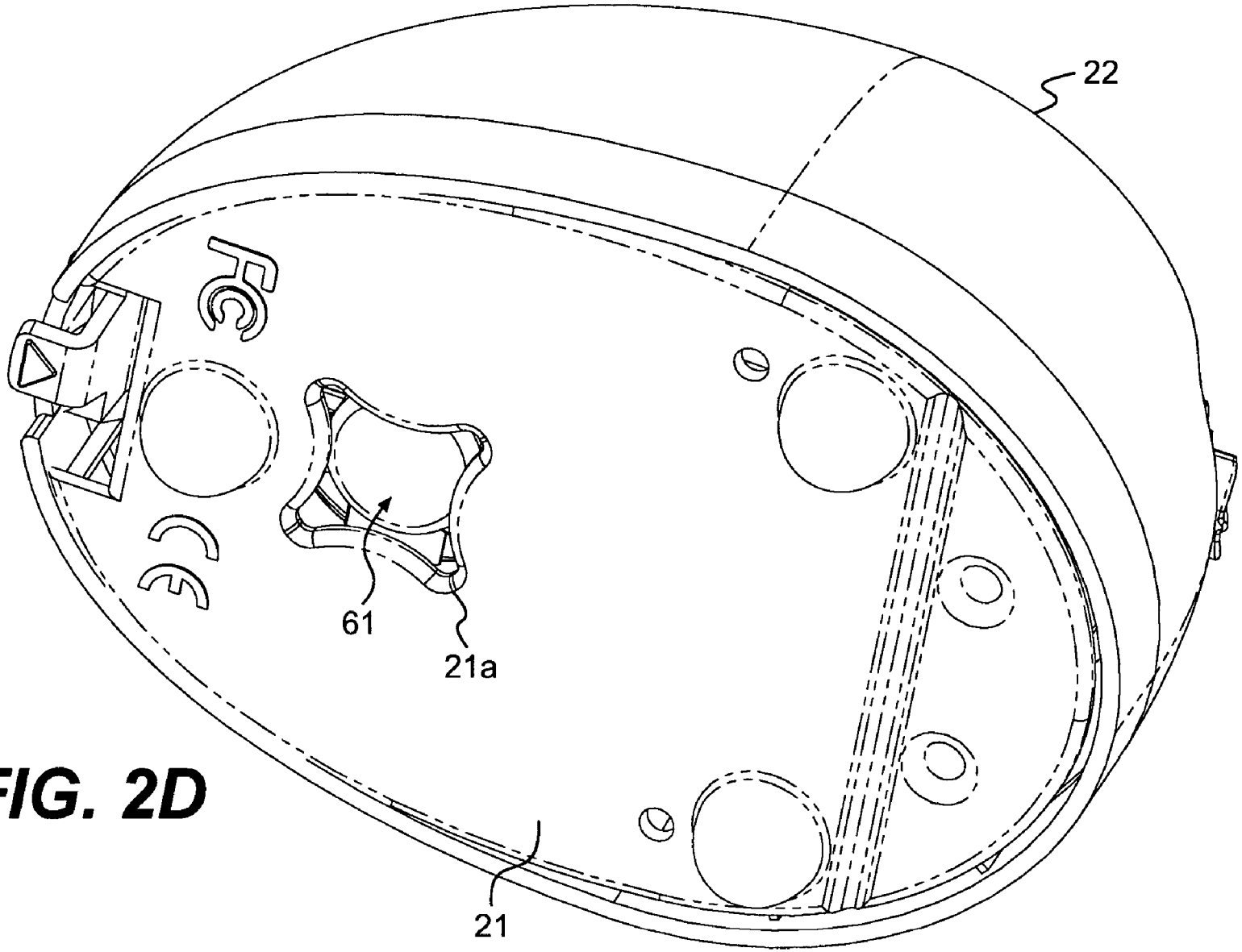

FIG. 2C depicts the device of FIG. 1B, as viewed at an angle from below with the base 21 not being shown. FIG. 2D depicts the device of FIG. 1B from the same angle as in FIG. 2C. In FIG. 2D, the base 21 is shown, and the DC brushless fan 61 is visible through an opening 21*a* formed in the base 21.

In this embodiment, the DC brushless fan 61 is used. However, other types of rotary fans are possible for use, depending on design considerations. Further, the placement of the fan is not limited to that shown in FIG. 1B. Rather, as long as the placement does not hinder liquid atomization and dispensing, any placement that allows the fan to promote airflow in or above the atomization device 20 and thereby enhance evaporation and dispersion of atomized liquid droplets dispensed through the orifice plate 37 is suitable.

Piezoelectric fans may also be used instead of rotary fans. In such an embodiment, the fan assembly 60 disposed beneath the reservoir assembly 30 of FIG. 1B would include a piezoelectric fan or fans. As well, any other placement that does not hinder liquid atomization and dispensing, and allows the piezoelectric fan to promote airflow in or above the atomization device 20 and thereby enhance evaporation and dispersion of atomized liquid droplets dispensed through the orifice plate 37, is suitable.

Fans for the atomizing device of our invention are not limited to rotary fans and piezoelectric fans. Any fan that can increase the airflow within or above the atomization device 20, and enhances the evaporation and dispersion of atomized liquid droplets dispensed through the orifice plate 37 such that the amount of atomized liquid droplets that re-settle before evaporating is reduced, is suitable.

Fan Operation

Preferably, when the liquid atomizing device dispenses liquid droplets for a set amount of time (for instance, 11 milliseconds) at predetermined intervals (for instance, every 12 seconds), the fan assembly 60 may be activated at predetermined times defined with respect to the predetermined intervals, and may remain on for a predetermined period following each activation.

For example, the fan 61 can be activated at the beginning of each set amount of time that the device dispenses the liquid droplets, that is, the fan is synchronized to activate when the atomizing device releases a puff of atomized liquid. After each activation, the fan then remains on for three seconds (for instance) before shutting off. As another example, the fan can be activated after each time that the device has dispensed the liquid droplets for the set amount of time, that is, the fan is synchronized to activate after the atomizing device has released a puff of atomized liquid. For instance, the fan can be set to activate one second following the release of a puff of liquid (one second into the predetermined interval that separates the release of two puffs of atomized liquid). Thereafter, the fan remains on for 2 seconds (for instance) before shutting off.

Alternatively, of course, the fan may remain on as necessary.

Heaters

Heater for the Orifice Plate

Figure 3B:
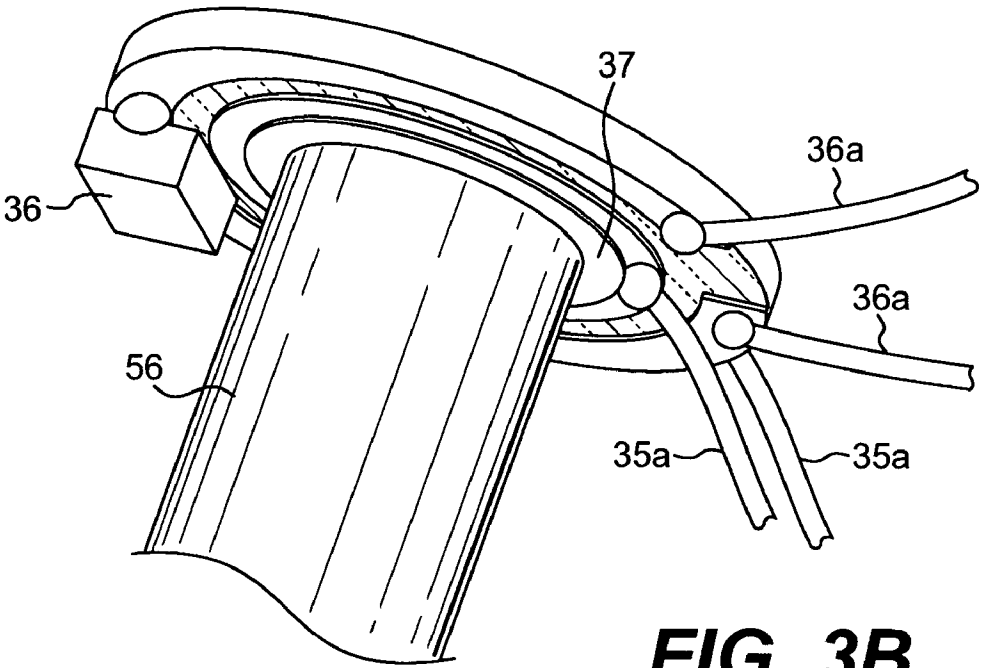
FIG. 3B is an elevational view of the orifice plate heater of FIG. 3A.
Figure 3A:
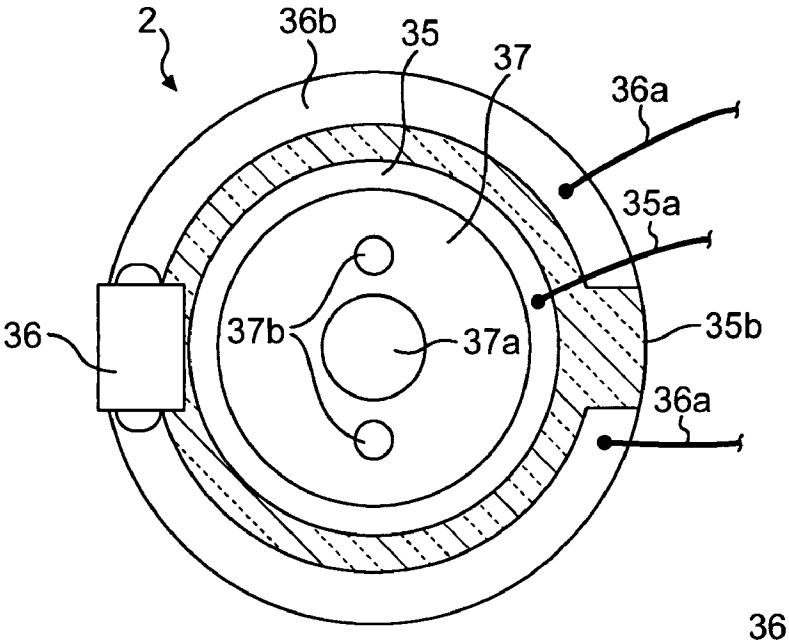
FIG. 3A shows a plan view of the lower surface of an orifice plate heater according to the invention.

FIG. 3A shows an orifice plate heater assembly 2. An orifice plate 37 has an area 37*a* which is formed with a plurality of minute apertures through which droplets of atomized liquid are dispensed. Drainage holes 37*b* may be formed in the orifice plate 37 to allow liquid to flow back to the wick. These drainage holes are described in detail in U.S. Pat. No. 6,341,732 B1 to Martin et al. The orifice plate 37 is soldered or otherwise connected to a piezoelectric element 35, which has an electrode on both the upper and lower surface thereof.

Two electric leads 35*a* are respectively attached to the electrodes on the upper and lower surface of the piezoelectric element 35. (The electric lead 35*a* attached to the upper surface of the piezoelectric element 35 is not shown in FIG. 3A.) The electric leads 35*a* convey alternating current (from the printed circuit board 28 as in FIG. 1B) to the piezoelectric element 35, causing it to expand and contract as previously described, creating vibrations that are communicated to the orifice plate 37.

An insulator 35*b* concentrically surrounds the piezoelectric element 35 and separates it from a resistor trace 36*b*, to which two electrical leads 36*a* are attached. A surface mount resistor 36 is disposed on the lower surface of the orifice plate heater assembly 2 in contact with the resistor trace 36*b* such that when current flows (from the printed circuit board 28 as in FIG. 1B) through the electrical leads 36*a* through the resistor trace 36*b* to the surface mount resistor 36, the resistor trace 36*b* heats up. The heat generated by the surface mount resistor 36, and transferred to the resistor trace 36*b*, heats the liquid passing through the area 37*a* of the orifice plate 37, resulting in an increase in the evaporation rate of the liquid droplets.

The heater for the orifice plate is not limited to the orifice plate heater assembly 2. Other orifice plate heater assemblies capable of heating liquid passing through the orifice plate 37 are possible.

Heater for the Wick

Figure 4:
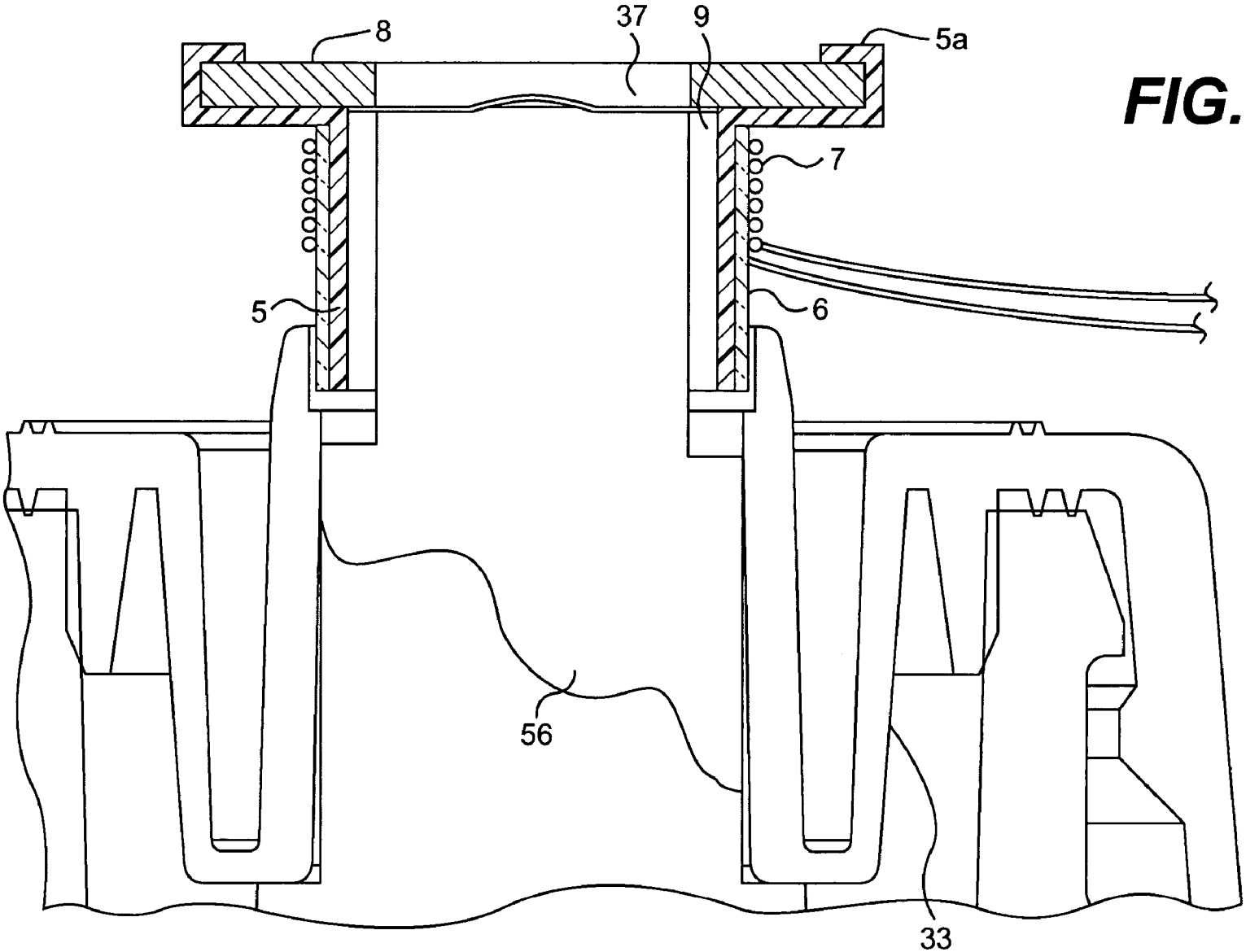
FIG. 4 is a cross-sectional view of a wick heater according to the invention.

FIG. 4 illustrates an example of a wick heater according to the invention. Thermally conducting tube 5, preferably composed of a non-metal material such as plastic, is disposed to surround an upper portion of the wick 56. An air gap 9 is formed between the wick 56 and the thermally conducting tube 5. Extensions of the tube 5 form crimp tabs 5*a* that secure piezoelectric pump 8 in three places along the periphery thereof (see FIG. 5 for a three-dimensional view of the crimp tabs 5*a* and the piezoelectric pump 8). An electrically insulating sleeve 6 surrounds the tube 5 and prevents the tube 5 from conducting heat away from the airgap 9.

Figure 5:
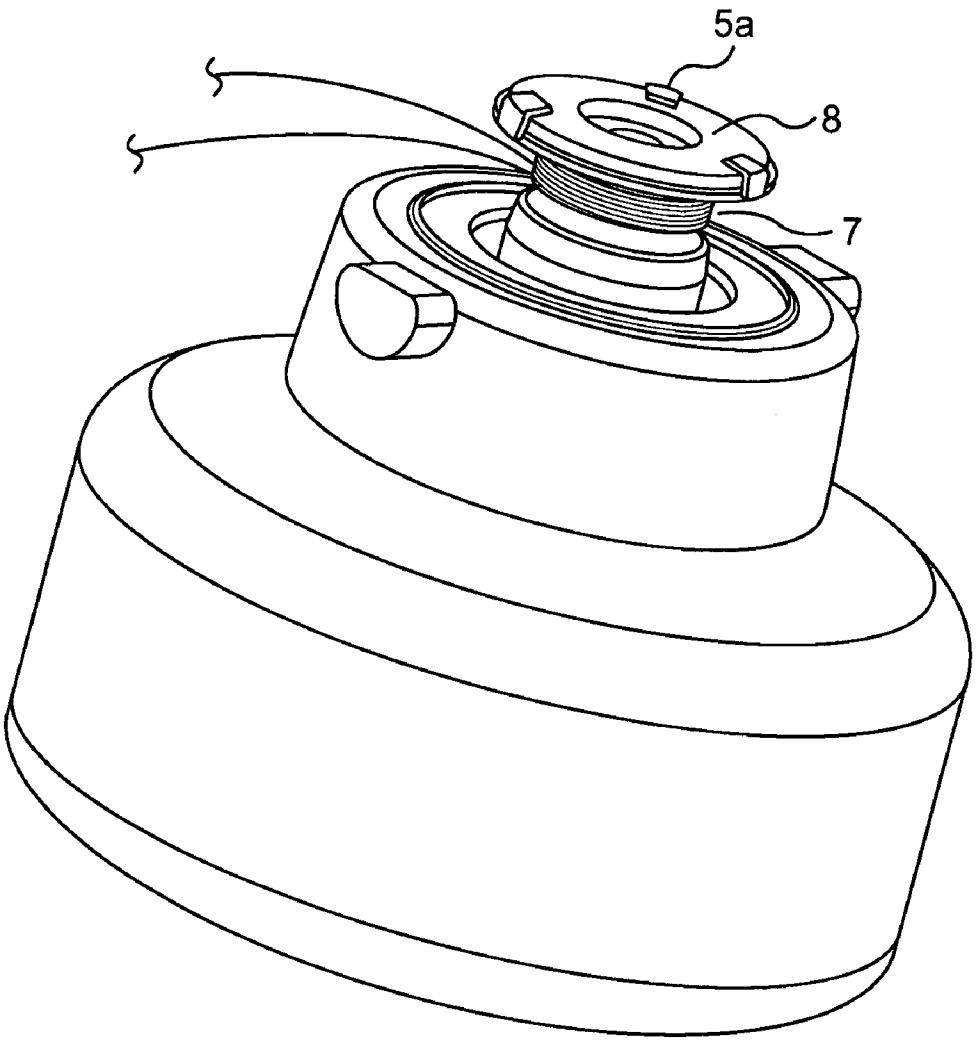
FIG. 5 is an elevational view of an embodiment of our invention using the wick heater of FIG. 4.

Heating wire 7, leading from printed circuit board 28 (as in FIG. 1B), is wound around the sleeve 6, as also shown in FIG. 5. When current flows from the printed circuit board 28 through the heating wire 7, heat is transferred from the heating wire 7 through the sleeve 6, the tube 5, and the air gap 9 to the wick 56. Thereby, the temperature of the liquid in the wick 56 (through which liquid is being delivered to the orifice plate 37) is raised. This results in an increase in the temperature of the liquid being atomized, which in turn increases the evaporation rate of the liquid dispensed as liquid droplets.

The wick heater is not limited to that shown in FIG. 4. For example, the heating element need not be a wire such as heating wire 7 of this embodiment. Other means of heating the wick are possible, as would be known to one of ordinary skill in the art. Such means need only be capable of elevating the temperature of liquid in the wick 56 so that when the liquid is dispensed, the heated liquid evaporates more quickly.

Heating Chamber

Figure 6A:
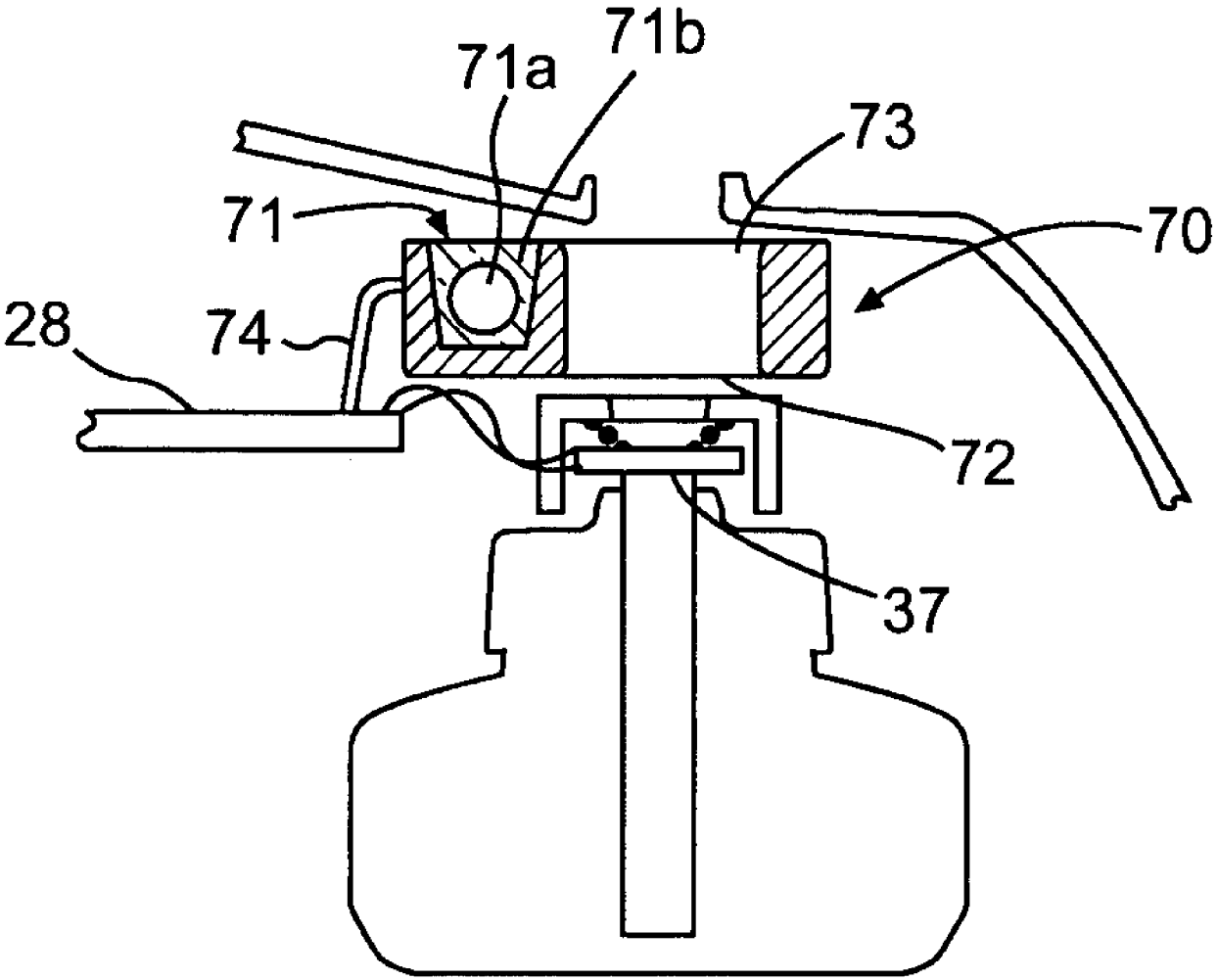
FIG. 6A is a cross-sectional view of an embodiment using a heating chamber according to our invention.
Figure 6B:
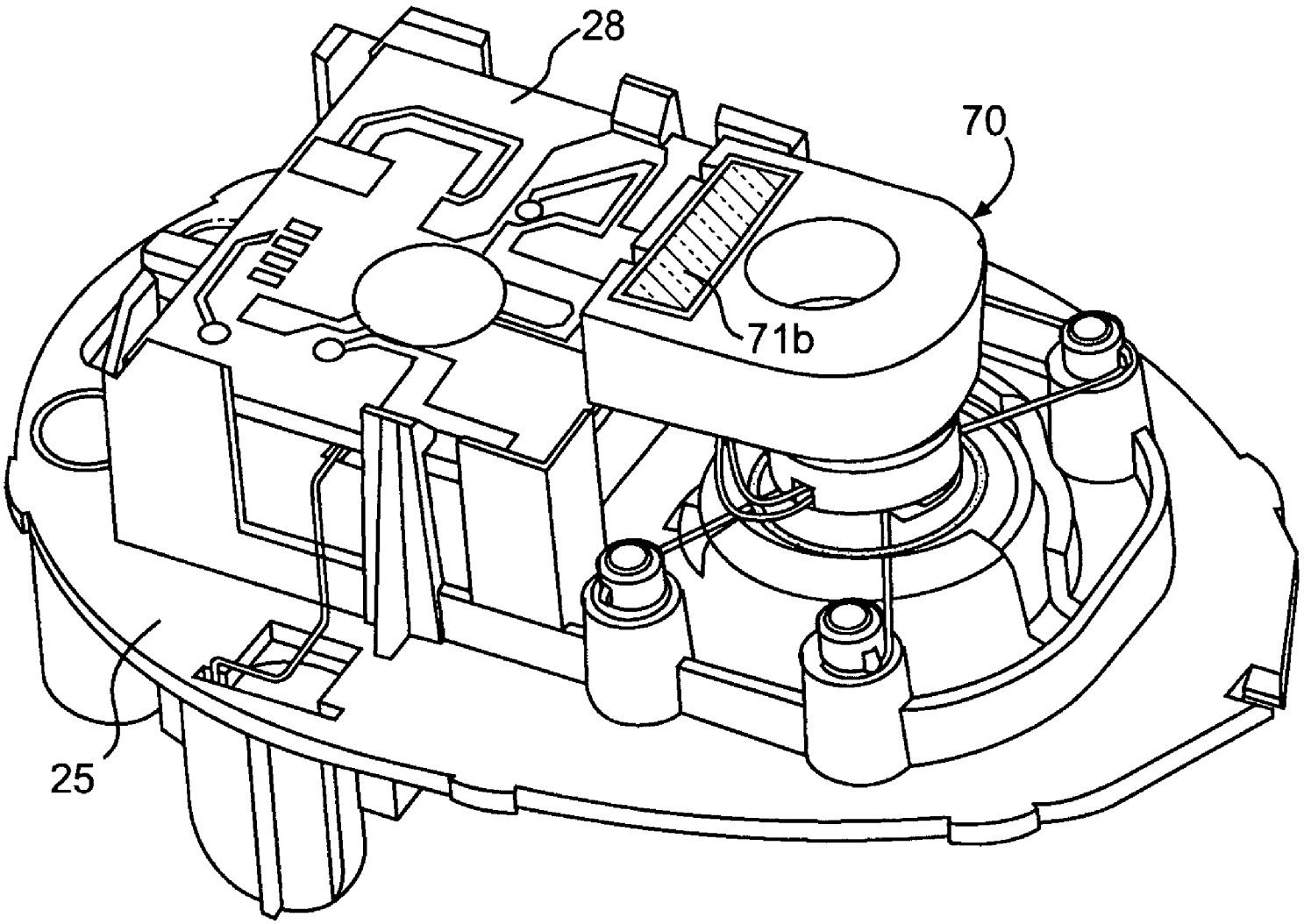
FIG. 6B is an elevational view of the embodiment shown in FIG. 6A.

In this embodiment, a device according to our invention heats the liquid droplets after the droplets have been ejected from the atomization device. As shown in FIGS. 6A and 6B, a heater assembly 70 has an inlet 72 through which liquid droplets dispensed from the orifice plate 37 enter the assembly 70, an outlet 73 through which the liquid droplets pass out of the assembly 70 into the ambient air, and a potted resistor element 71 preferably comprising a resistor 71*a* potted in a ceramic housing 71*b* with ceramic cement.

Wires 74 from the printed circuit board 28 connect to the resistor 71*a* to cause the resistor 71*a* to heat when a current is passed through it, which in turn causes the entire heater assembly 70 to heat up.

The heater assembly 70 elevates the temperature of the air inside a chamber defined by the heater assembly 70, beginning with inlet 72 and ending with outlet 73. This creates airflow in the chamber that transfers heat to liquid droplets passing through the chamber so that the temperature of the liquid droplets is elevated, enhancing evaporation. Also, preferably, convection currents caused by the heating chamber help liquid droplet dispersion by moving particles to a greater height, increasing the amount of time that the liquid droplets have to evaporate before settling occurs. Of course, other configurations for providing a heated chamber are possible, as would be understood by one of ordinary skill in the art.

Heater Provided on the Printed Circuit Board

Figure 7:
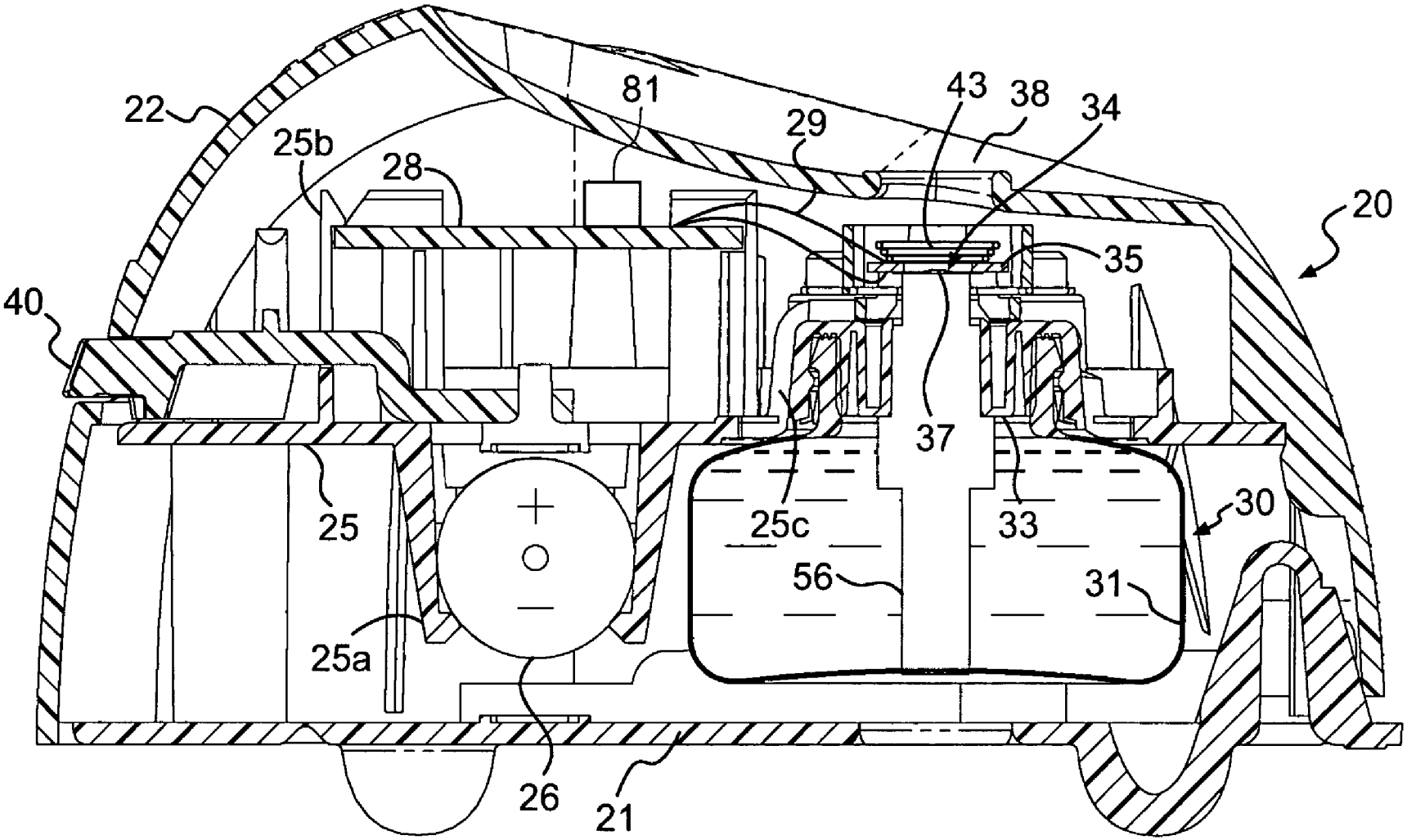
FIG. 7 is a cross-sectional view of an embodiment of our invention employing a circuit board heater.

FIG. 7 shows a heating element 81 provided on the printed circuit board 28. When the heating element 81 is heated, the temperature of the air inside the atomization device 20 is raised. This heating of the air preferably causes airflow through the opening 38 of the atomization device 20 through simple convection, enhancing the evaporation and dispersion of dispensed liquid droplets. Heating element 81 is preferably a resistance type heater.

Combinations of Fans and/or Heaters

While we have discussed liquid atomizing devices having either a fan or a heater, it is also possible to provide, for a single device, a combination of fans, a combination of heaters, or a combination of fan(s) and heater(s), in order to further enhance evaporation of the liquid being dispensed.

While particular embodiments of the present invention have been illustrated and described, it will be apparent to those skilled in the art that various changes and modifications may be made without departing from the spirit and scope of the invention. Furthermore, it is intended that the claims will cover all such modifications that are within the scope of the invention.

INDUSTRIAL APPLICABILITY

This invention provides liquid atomizing devices that are able to reduce the amount of atomized liquid droplets that settle onto adjacent surfaces before they can evaporate. We envision that the devices can preferably be used to dispense fragrances or insecticides, or to deliver medical, cosmetic, or humidifying sprays.

We claim:

1. A liquid atomizing device for dispensing liquid droplets, the liquid droplets being provided from a container holding a liquid, the container comprising a porous wick positioned to communicated the liquid from the container, the device comprising:

an orifice plate with apertures, the orifice plate being vibrated by a piezoelectric clement to cause liquid communicated from the container to be atomized and dispensed as liquid droplets through the apertures;

an insulator surrounding the piezoelectric element;

an orifice plate heating assembly comprising a heating element and a resistor trace coupled to the orifice plate and separated from the piezoelectric element by the insulator, wherein the heating element heats the liquid communicated from the container, thereby increasing the evaporation rate of the liquid droplets.

2. The liquid atomizing device according to claim 1, further comprising the container holding the liquid.

3. The liquid atomizing device according to claim 1, wherein the heating element is a surface mount resistor.

4. The liquid atomizing device according to claim 1, further comprising electrical leads connected to the heating element, wherein electrical current flows through the electrical leads to the heating element.

5. The liquid atomizing device according to claim 1, further comprising a fan disposed substantially outside a main body defined by the container and the orifice plate, wherein the fan acts to increase at least one of the evaporation rate and dispersion of the liquid droplets dispensed through the apertures of the orifice plate.

6. A liquid atomizing device for dispensing liquid droplets, the liquid droplets being provided from a container holding a liquid, the container comprising a wicking element having a porous wick positioned to communicate the liquid from the container, the device comprising:

an orifice plate with apertures, the orifice plate being vibrated by a piezoelectric element to cause liquid communicated from the container to be atomized and dispensed as liquid droplets through the apertures;

a thermally conducting tube surrounding a top portion of the wicking element when the container is mounted to the device; and a heating element coupled to the thermally conducting tube, the heating element heating the top portion of the wicking element, wherein heat from the heating element raises the temperature of the liquid in the wick which is being delivered to the orifice plate, thereby increasing the evaporation rate of the liquid dispensed as liquid droplets.

7. The liquid atomizing device according to claim 6, further comprising the container holding the liquid.

8. The liquid atomizing device according to claim 6, wherein an air gap is formed between the wick and the thermally conducting tube.

9. The liquid atomizing device according to claim 8, wherein the thermally conducting tube comprises a non-metal material.

10. The liquid atomizing device according to claim 6, wherein the thermally conducting tube includes extensions forming crimp tabs securing the piezoelectric element in a plurality of places along the periphery of the piezoelectric element.

11. The liquid atomizing device according to claim 6, further comprising an electrically insulating sleeve surrounding the thermally conducting tube.

12. The liquid atomizing device according to claim 11, wherein the heating element is a wire that is wound around the electrically insulating sleeve.

13. The liquid atomizing device according to claim 6, further comprising a fan disposed substantially outside a main body defined by the container and the orifice plate, wherein the fan acts to increase at least one of the evaporation rate and dispersion of the liquid droplets dispensed through the apertures of the orifice plate.

* * * * *